US010228186B2

(12) United States Patent
Yang et al.

(10) Patent No.: US 10,228,186 B2
(45) Date of Patent: Mar. 12, 2019

(54) REFRIGERATOR

(71) Applicant: LG ELECTRONICS INC., Seoul (KR)

(72) Inventors: Changwoan Yang, Seoul (KR); Hyeongil Kim, Seoul (KR); Heonjae Jang, Seoul (KR); Booyoun Lee, Daegu (KR)

(73) Assignee: LG Electronics Inc., Seoul (KR)

( * ) Notice: Subject to any disclaimer, the term of this patent is extended or adjusted under 35 U.S.C. 154(b) by 13 days.

(21) Appl. No.: 15/424,050

(22) Filed: Feb. 3, 2017

(65) Prior Publication Data

US 2017/0234607 A1 Aug. 17, 2017

(30) Foreign Application Priority Data

Feb. 5, 2016 (KR) ..... 10-2016-0015056

(51) Int. Cl.

| | |
|---|---|
| ***F25D 25/02*** | (2006.01) |
| ***F25D 23/02*** | (2006.01) |
| ***F25D 23/06*** | (2006.01) |
| ***A47B 88/453*** | (2017.01) |
| ***A47B 88/487*** | (2017.01) |
| ***F25D 11/02*** | (2006.01) |
| ***A47B 96/16*** | (2006.01) |

(Continued)

(52) U.S. Cl.

CPC ..... *F25D 25/025* (2013.01); *A47B 88/453* (2017.01); *A47B 88/487* (2017.01); *A47B 96/16* (2013.01); *F25D 11/02* (2013.01); *F25D 23/067* (2013.01); *A47B 88/41* (2017.01); *A47B 88/42* (2017.01); *A47B 2210/0027* (2013.01); *A47B 2210/175* (2013.01); *F25D 23/028* (2013.01)

(58) Field of Classification Search

CPC .... F25D 25/025; F25D 25/024; F25D 23/028; F25D 23/067

See application file for complete search history.

(56) References Cited

U.S. PATENT DOCUMENTS 1,899,171 A * 2/1933 Warren ..... F25D 25/027 126/340
2,795,117 A * 6/1957 Herndon, Jr. ..... F25B 39/024 62/289

(Continued)

FOREIGN PATENT DOCUMENTS

CN 1940439 A * 4/2007
EP 2250929 A1 * 11/2010 ..... A47B 96/16

(Continued)

*Primary Examiner* — Kimberley S Wright
(74) *Attorney, Agent, or Firm* — Fish & Richardson P.C.

(57) ABSTRACT

A refrigerator includes a cabinet defining a storage compartment, a door, a drawer, a roller at a side of the drawer, and a withdrawal frame in the storage compartment configured to support the drawer and move in a forward-rearward direction, and a link rotatably that is connected to the door and a connection shaft, that is configured to move the withdrawal frame forward based on the door being opened and to move the withdrawal frame rearward based on the door being closed, and that defines, along a longitudinal direction of the link, a connection hole that is configured to receive the connection shaft, the link being located at the withdrawal frame.

14 Claims, 7 Drawing Sheets

(51) Int. Cl.
*A47B 88/41* (2017.01)
*A47B 88/42* (2017.01)

(56) References Cited

U.S. PATENT DOCUMENTS 5,209,555 A * 5/1993 Camilleri ..... A47B 88/402 312/311
6,378,969 B1 * 4/2002 Ferrari ..... A47B 88/467 312/334.12
7,766,437 B2 * 8/2010 Lim ..... F25D 25/024 312/330.1
8,002,369 B2 * 8/2011 Bello ..... A47B 88/40 312/334.22
8,403,437 B2 * 3/2013 Bergmann ..... F25D 25/021 312/334.1
9,217,602 B2 * 12/2015 Lee ..... F25D 25/02
9,726,423 B1 * 8/2017 Swarnkar ..... F25D 25/024
9,897,371 B2 * 2/2018 Yang ..... F25D 25/025
9,933,201 B2 * 4/2018 Yi ..... F25D 21/14
9,939,192 B2 * 4/2018 Yang ..... F25D 25/024
2005/0156494 A1 * 7/2005 Bergmann ..... F25D 25/021 312/404
2010/0307186 A1 * 12/2010 Kwon ..... F25D 23/028 62/407
2014/0252937 A1 * 9/2014 Lee ..... F25D 25/02 312/404
2014/0300264 A1 * 10/2014 Park ..... F25D 25/025 312/404
2016/0018157 A1 * 1/2016 Dubina ..... F25D 23/021 312/404
2017/0227279 A1 * 8/2017 Yang ..... F25D 25/024
2017/0227280 A1 * 8/2017 Yang ..... F25D 25/025
2017/0227281 A1 * 8/2017 Yang ..... F25D 25/025
2017/0350642 A1 * 12/2017 Yang ..... F25D 25/025
2018/0038632 A1 * 2/2018 Yang ..... F25D 25/025

FOREIGN PATENT DOCUMENTS

EP 2976971 A1 * 1/2016 ..... A47B 96/16
WO WO-03065846 A1 * 8/2003 ..... A47B 46/00

* cited by examiner

REFRIGERATOR

CROSS-REFERENCE TO RELATED APPLICATION

The application claims priority under 35 U.S.C. § 119 and 35 U.S.C. § 365 to Korean Patent Application No. 10-2016-0015056, filed Feb. 5, 2016, whose entire disclosure is hereby incorporated by reference.

FIELD

The present disclosure relates to a refrigerator.

BACKGROUND

A refrigerator is an electric home appliance that is used to store food in a refrigerated state or in a frozen state. In recent years, the capacity of refrigerators has increased, and a home bar, an ice maker, a shelf, or a door box has been mounted on the rear of a door of the refrigerator.

SUMMARY

It is an object of the present disclosure to provide a refrigerator configured such that a withdrawal frame for supporting a drawer is connected to a door via a link, such that the withdrawal frame is automatically withdrawn and inserted in response to the opening and closing operation of the door, and such that the withdrawal frame starts to be withdrawn only when the door is turned to a predetermined angle or more.

It is another object of the present disclosure to provide a refrigerator configured such that the withdrawal operation of the withdrawal frame is achieved using a link.

According to an innovative aspect of the subject matter described in this application, a refrigerator includes a cabinet that defines a storage compartment with an opening; a door rotatably coupled to the cabinet and configured to open and close the opening; a drawer located in the storage compartment and configured to store food; a roller located at a side of the drawer; a withdrawal frame that is located in the storage compartment, that is configured to support the drawer, and that is configured to move in a forward-rearward direction; and a link that is rotatably connected to the door at a side of the link and rotatably connected to a connection shaft at an other side of the link, that is configured to move the withdrawal frame forward based on the door being opened and to move the withdrawal frame rearward based on the door being closed, and that defines, along a longitudinal direction of the link, a connection hole that is configured to receive the connection shaft, the link being located at the withdrawal frame.

The refrigerator may include one or more of the following optional features. The connection hole is configured to guide movement of the connection shaft in a direction that is perpendicular to a center axis of the connection shaft. A rear end of the connection hole is nearer to a rear of the refrigerator than a front end of the connection hole and is spaced apart from the connection shaft based on the door being closed. The rear end of the connection hole is configured to contact the connection shaft based on the door being opened to a predetermined withdrawal start angle defined with respect to a front surface of the refrigerator. The predetermined withdrawal angle is less than or equal to 90 degrees. The connection shaft is spaced apart from the front end of the connection hole based on the door being opened to a maximum withdrawal angle defined with respect to a front surface of the refrigerator. The maximum withdrawal angle is greater than 90 degrees.

The withdrawal frame includes a horizontal base part; a side part that extends upward from the horizontal base part; and a drawer guide that is located at the side part, that is configured to support the roller, and that is configured to guide the roller in the forward-rearward direction. The withdrawal frame further includes an additional side part that extends from the horizontal base part; and an additional drawer guide that is located at the additional side part and that faces the drawer guide. The connection shaft protrudes downward from the horizontal base part. The withdrawal frame further includes a pair of frame legs protruding from a bottom surface of the horizontal base part, spaced apart from each other in a lateral direction of the storage compartment, and each including a plurality of rollers configured to move along a bottom of the storage compartment in the forward-rearward direction.

The withdrawal frame further includes a guide rail located at the bottom of the storage compartment and configured to guide movement of the pair of frame legs in the forward-rearward direction; a vertical partition that divides the interior of the storage compartment into a left part and a right part. The vertical partition and the guide rail define a space that is configured to receive a first frame leg of the pair of frame legs. The withdrawal frame further includes a pair of additional guide rails that define a space that is configured to receive a second frame leg of the pair of frame legs; additional drawers that located above or below the drawer; and additional drawer guides that are located at the withdrawal frame and that are configured to guide the additional drawers.

BRIEF DESCRIPTION OF THE DRAWINGS

FIG. 4(*b*) is an enlarged perspective view of an example second frame leg between a second guide rail and a third guide rail.

DETAILED DESCRIPTION

Figure 1:
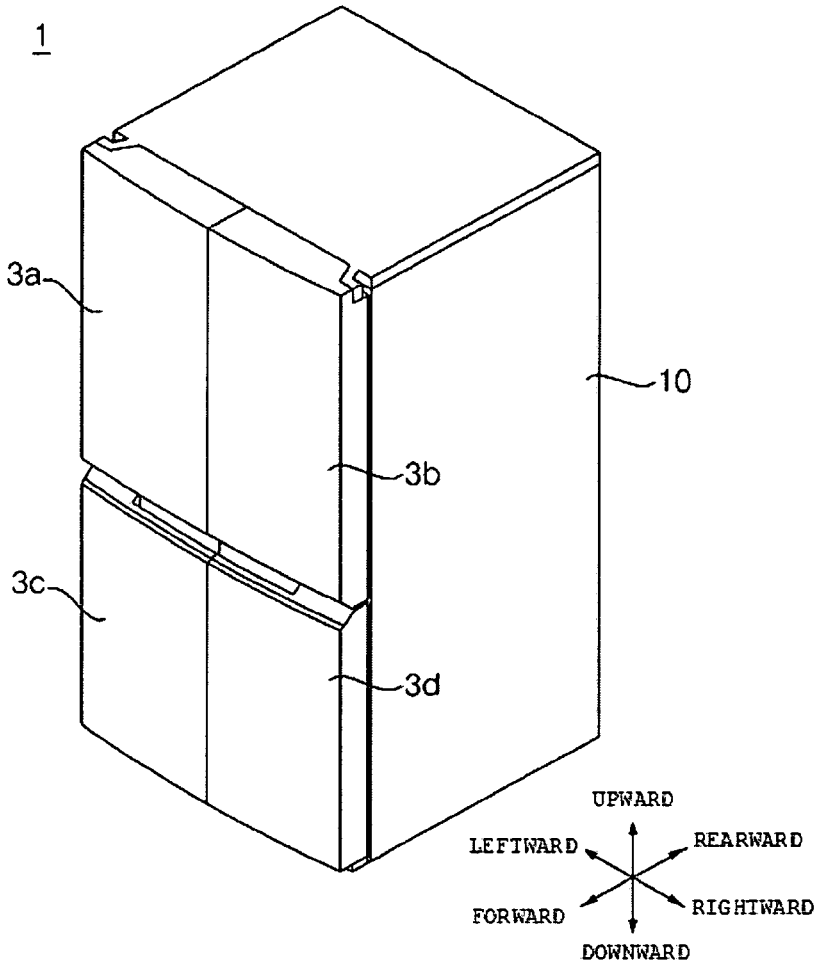
FIG. 1 is a perspective view of an external appearance of an example refrigerator.
Figure 2:
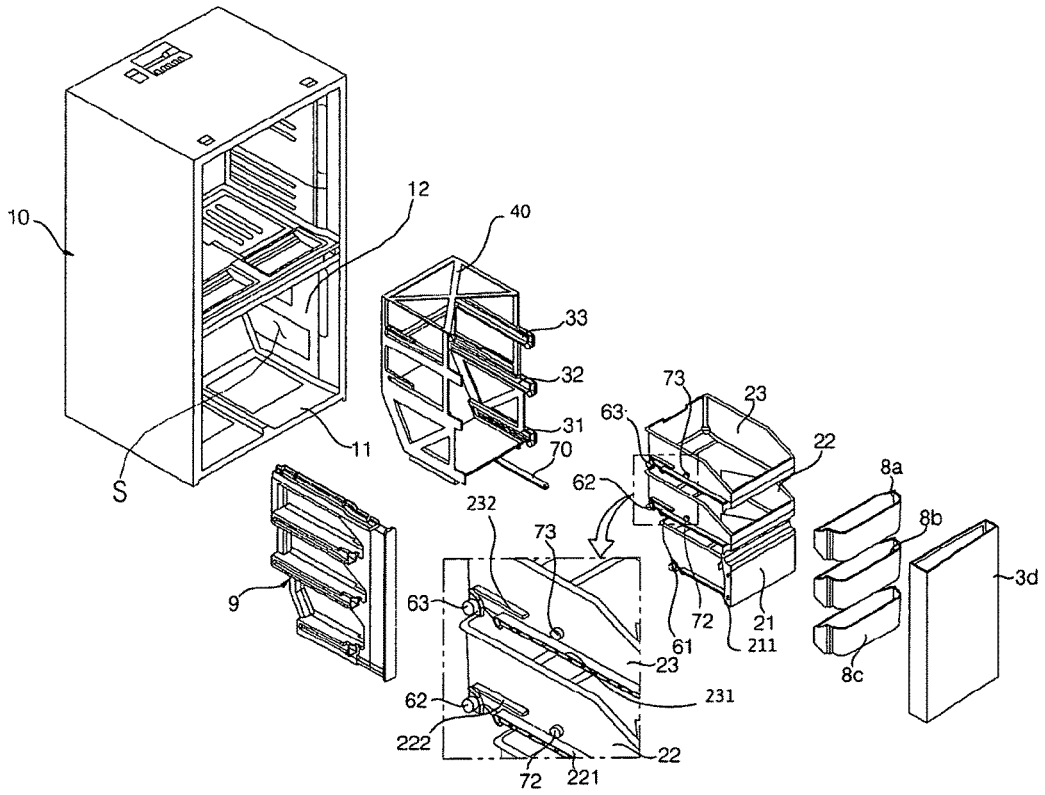
FIG. 2 is an exploded perspective view of main parts of an example refrigerator.
Figure 3:
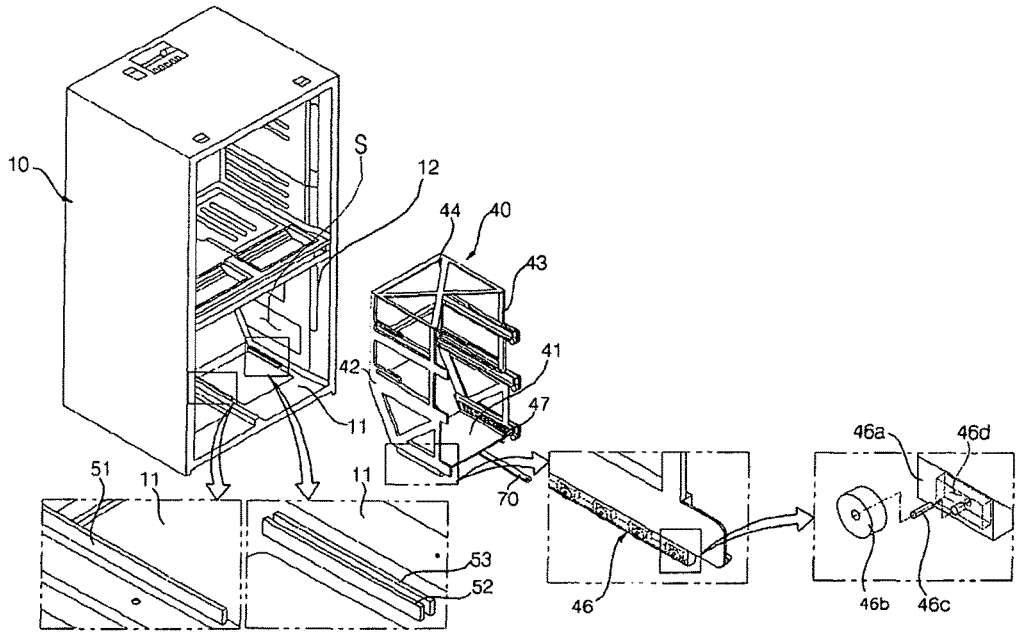
FIG. 3 is an exploded perspective view of a example cabinet and an example withdrawal frame.
Figure 4A:
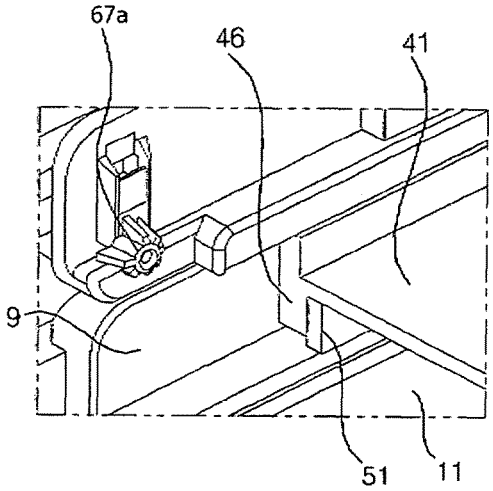
FIG. 4(*a*) is an enlarged perspective view of an example first frame leg between a first guide rail and a vertical partition.
Figure 4B:
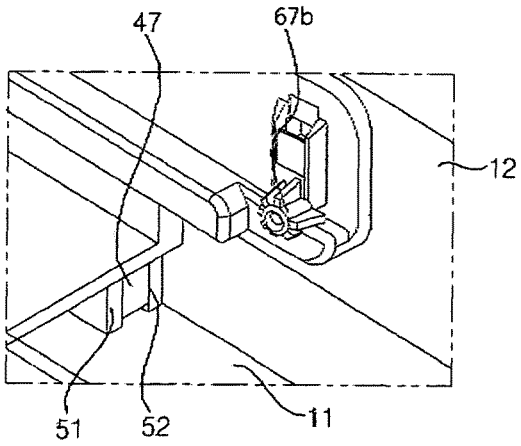
Figures 5A, 5B, 5C:
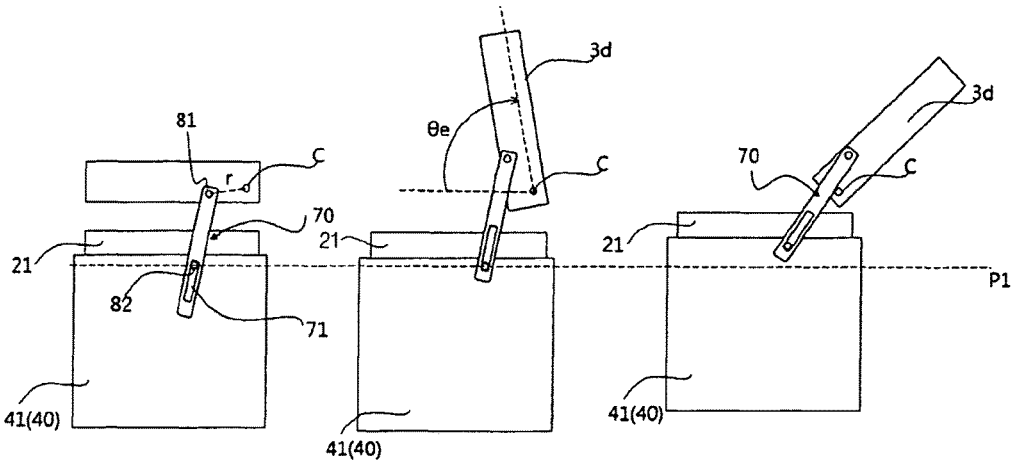
FIGS. 5(*a*)-5(*e*) are top-down illustrations of example states of a link, a connection shaft, and a base part based on a rotational angle of a door.
Figures 5D, 5E:
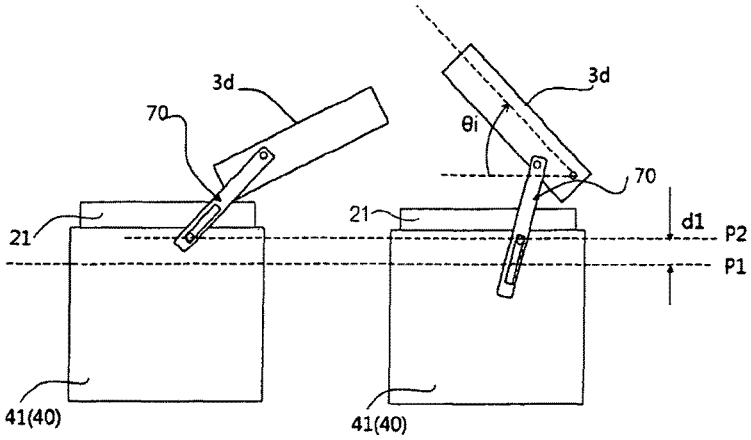
Figure 6:
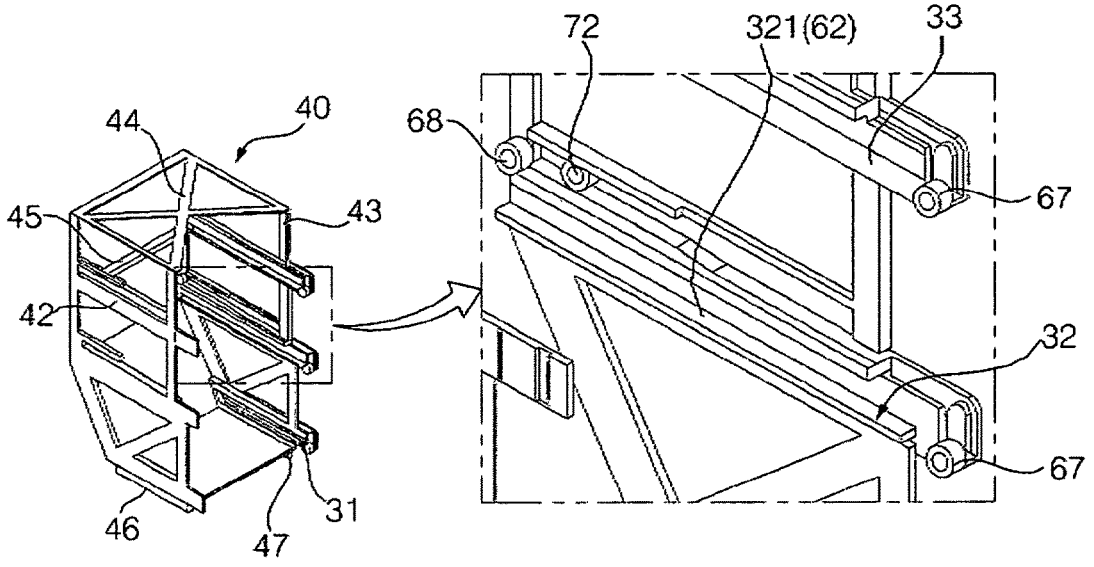
FIG. 6 is an enlarged perspective view of an example withdrawal frame.
Figure 7:
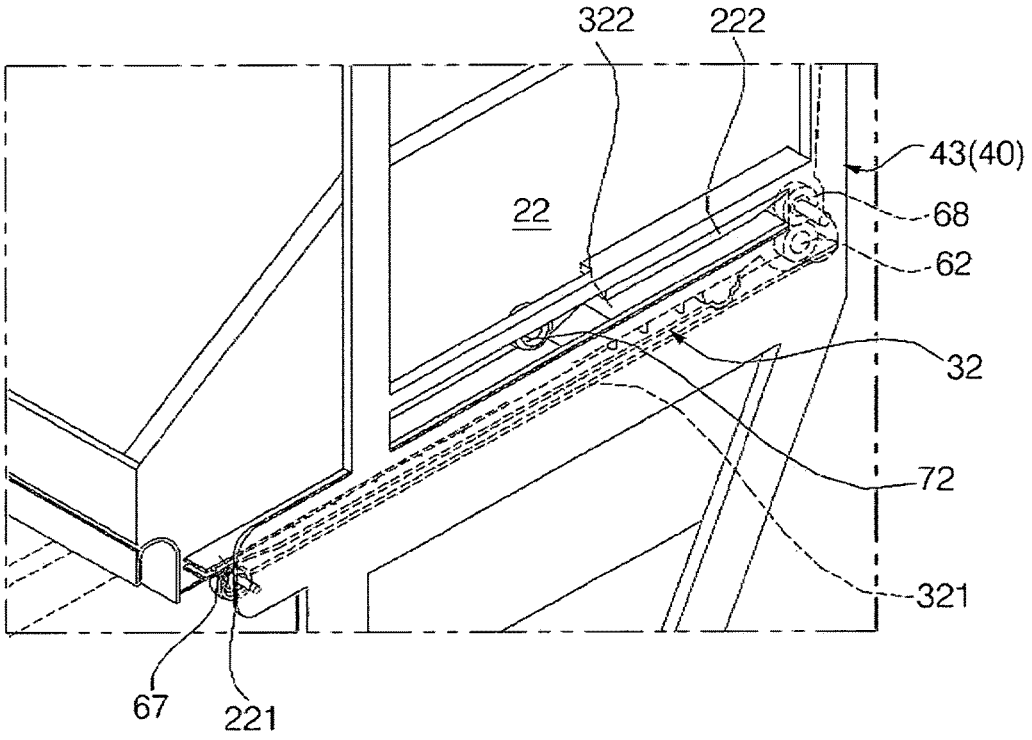
FIG. 7 is an enlarged view of an example second drawer installed at second drawer guides.

FIG. 1 illustrates an example refrigerator 1. FIG. 2 illustrates example main parts of a refrigerator 1. FIG. 3 illustrates an example cabinet 10 and an example withdrawal frame 40 illustrated in FIG. 2. FIGS. 4(*a*) and (*b*) illustrate example structures in which a first frame leg 46 is installed between a first guide rail 51 provided on the bottom 11 of the cabinet and a vertical partition 9 in the state in which the withdrawal frame 40 illustrated in FIG. 2 is installed in the cabinet 10 and in which a second frame leg 47 is installed between a second guide rail 52 and a third guide rail 53 provided on the bottom 11 of the cabinet in the state in which the withdrawal frame illustrated in FIG. 2 is installed in the cabinet. FIG. 5 illustrates an example link 70, an example connection shaft 82, and an example base part 41 depending on the rotational angle of a door 3*d*. FIG. 6 illustrates an example withdrawal frame 40 illustrated in FIGS. 2 and 3. FIG. 7 illustrates an example second drawer 22 installed at an example second drawer guides 32.

FIG. 1 also illustrates a definition of "forward", "rearward", "leftward", "rightward", "upward", and "downward" directions set forth herein. However, these directions are used merely to clearly describe the present disclosure. Consequently, the above directions may be differently defined in some implementations.

Referring to FIGS. 1 to 3, a refrigerator 1 may include a cabinet 10 having compartments RC and FC defined therein and doors 3*a*, 3*b*, 3*c*, and 3*d* for opening and closing the compartments RC and FC. The doors 3*a*, 3*b*, 3*c*, and 3*d* may be hinged to the cabinet 10.

The front surfaces of the compartments RC and FC are open such that food is introduced and removed through the front surfaces of the compartments RC and FC. The open front surfaces of the compartments RC and FC may be opened and closed by the doors 3*a*, 3*b*, 3*c*, and 3*d*. Cool air is supplied into the compartments RC and FC. The compartments RC and FC may be sealed by the doors 3*a*, 3*b*, 3*c*, and 3*d* such that cool air does not leak from the compartments RC and FC.

Two or more compartments RC and FC may be provided. For a bottom freezer type refrigerator, the cabinet 10 is partitioned into the upper part and the lower part, and the compartments RC and FC are respectively provided in the upper part and the lower part of the cabinet 10. In this case, the lower compartment FC is a freezing compartment, the interior temperature of which is maintained below 0° C., and the upper compartment RC is a refrigerating compartment, the interior temperature of which is maintained above 0° C. In the following description, a "compartment" may be a refrigerating compartment or a freezing compartment, unless mentioned otherwise.

Each of the compartments RC and FC may be opened and closed by a pair of doors. In some implementations, the refrigerating compartment RC may be opened and closed by a pair of refrigerating compartment doors 3*a* and 3*b*, and the freezing compartment FC may be opened and closed by a pair of freezing compartment doors 3*c* and 3*d*.

A storage compartment S constitutes all or portions of the compartments RC and FC. The storage compartment S may be defined as a region that is opened and closed by the doors 3*a*, 3*b*, 3*c*, and 3*d*. One compartment may constitute one storage compartment. In some implementations, one compartment (e.g. the freezing compartment FC) may be partitioned into left and right storage compartments by the vertical partition 9. The flow of cool air between the storage compartments may not be completely blocked by the vertical partition 9. In some implementations, the vertical partition 9 may be provided with through holes, through which the storage compartments communicate with each other.

Hereinafter, the storage compartment S will be referred to as a right storage compartment of the freezing compartment FC, a description of which will follow. However, the following description may be applied to other storage compartments.

Door storage units 8*a*, 8*b*, and 8*c* for storing food may be formed in the rear part of the door 3*d*, e.g. the part of the door 3*d* that face the open front surface of the storage compartment S. The door storage units 8*a*, 8*b*, and 8*c* protrude rearward from the rear part of the door 3*d* for providing spaces for storing food that is frequently taken out of the refrigerator, such as dairy products, beverages, vegetables, etc. In the state in which the door 3*d* is closed, the door storage units 8*a*, 8*b*, and 8*c* are located in the storage compartment S.

At least one drawer may be disposed in the storage compartment S. The drawer is provided to store or hold food. A plurality of drawers 21, 22, and 23 may be arranged in the upward-downward direction. Each of the drawers 21, 22, and 23 is formed in the shape of a box that provides a predetermined sized food storage space. Each of the drawers is also referred to as a container or a bin.

At least one drawer may be provided in the storage compartment S. Hereinafter, three drawers 21, 22, and 23 will be described as being disposed in the storage compartment S, which is located at the right side of the vertical partition 9, so as to be arranged at different heights in the upward-downward direction. Hereinafter, the drawers 21, 22, and 23 will be referred to as a first drawer 21, a second drawer 22, and a third drawer 23, respectively.

At least one roller may be provided at each side of each of the drawers 21, 22, and 23. FIG. 2 illustrates a roller 61 provided at one side of the first drawer 21. Another roller 61 is also provided at the other side of the first drawer 21. Two rollers 72 and 62 are located at one side of the second drawer 22 in the state of being arranged in the forward-rearward direction and two rollers 73 and 63 provided at one side of the third drawer 23 in the state of being arranged in the forward-rearward direction. A pair of rollers may be provided at the other side of each of the drawers 22 and 23. Hereinafter, the front ones of the rollers provided at the drawers 22 and 23 will be referred to as front rollers 72 and 73, and the rear ones of the rollers provided at the drawers 22 and 23 will be referred to as rear rollers 62 and 63. The front rollers 72 and 73 may be located higher than the rear rollers 62 and 63.

A withdrawal frame 40 for holding the drawers 21, 22, and 23 may be provided in the storage compartment S so as to be movable in the forward-rearward direction. The drawers 21, 22, and 23 may be directly supported by the withdrawal frame 40. In some implementations, as will be described hereinafter, the withdrawal frame 40 may be provided with pairs of drawer guides 31, 32, 33 corresponding to the drawers 21, 22, and 23, respectively, such that the rollers provided at the drawers 21, 22, and 23 are movable along the drawer guides 31, 32, 33.

The withdrawal frame 40 may be interlocked with the door 3*d*. In some implementations, when the door 3*d* is opened, the withdrawal frame 40 may move forward or be withdrawn. When the door 3*d* is closed, the withdrawal frame 40 may move rearward or be inserted. A link 70 for interconnecting the withdrawal frame 40 and the door 3*d* may be provided such that the withdrawal frame 40 is interlocked with the door 3*d*.

The withdrawal frame 40 is formed in the shape of a box having an open front surface. The withdrawal frame 40 may include a horizontal base part 41 disposed at the lower side of the first drawer 21, a pair of side parts 42 and 43 extending upward from the opposite side ends of the base part 41 so as to face each other, a rear part 45 for interconnecting rear ends of the side parts 42 and 43 (see FIG. 6), and a top part 44 for connecting the upper ends of the side parts 42 and 43 to the upper end of the rear part 45.

In some implementations, the side parts 42 and 43, the rear part 45, and the top part 44 may be made of a solid plate.

The side parts 42 and 43, the rear part 45, and the top part 44 may be provided therein with openings. The entire weight of the withdrawal frame 40 may be reduced by the provision of the openings, and cool air in the storage compartment S may be smoothly circulated through the openings in the withdrawal frame 40.

At least one guide rail for guiding the movement of the withdrawal frame 40 in the forward-rearward direction may be disposed at the bottom of the storage compartment S or the inner bottom 11 of the cabinet 10. The guide rail may extend along the bottom 11 of the storage compartment S in the forward-rearward direction. A plurality of guide rails 51, 52, and 53 may be provided. The guide rails 51, 52, and 53 may be spaced apart from each other in the lateral direction so as to be parallel to each other.

Frame legs 46 and 47 may protrude downward from the bottom surface of the base part 41 of the withdrawal frame 40. The frame legs 46 and 47 may extend in the forward-rearward direction. The frame legs 46 and 47 may be spaced apart from each other in the lateral direction of the storage compartment S. Hereinafter, the frame legs 46 and 47 will also be referred to as a first frame leg 46 and a second frame leg 47, respectively.

The frame legs 46 and 47 may support the load of the withdrawal frame 40. In addition, the frame legs 46 and 47 may move along the guide rails 51, 52, and 53 simultaneously with the withdrawal frame 40 when the withdrawal frame 40 is moved by the link 70.

As illustrated in FIGS. 3 and 4, each of the frame legs 46 and 47 may include a leg body 46*a* extending in the forward-rearward direction and at least one roller 46*b* rotatably provided at the leg body 46*a*. The leg body 46*a* is provided with a plurality of roller installation recesses 46*d*, the lower surface of each of which is open. The roller installation recesses 46*d* are arranged in the forward-rearward direction. The rollers 46*b* are rotatably connected to rotary shafts 46*c*, which extend through opposite sidewalls of the respective roller installation recesses 46*d*, in the state of being inserted into the roller installation recesses 46*d*. The rollers 46*b* roll along the bottom 11 of the storage compartment S in the state of being installed in the roller installation recesses 46*d*, whereby the withdrawal frame 40 is moved.

In some implementations in which one compartment FC is partitioned into two parts by the vertical partition 9, the first guide rail 51 may be provided at the side of the vertical partition 9 in one storage compartment S, and the second guide rail 52 and the third guide rail 53 may be disposed at the side of the inner surface 12 of the cabinet 10 that is opposite the vertical partition 9.

The first frame leg 46 may be disposed between the vertical partition 9 and the first guide rail 51, and the second frame leg 47 may be disposed between the second guide rail 52 and the third guide rail 53. The lower end of the vertical partition 9 that contacts the bottom 11 of the cabinet 10 may be perpendicular to the bottom 11. In this case, if the first guide rail 51 is substantially spaced apart from the lower end of the vertical partition 9 by a distance equivalent to the width of the first frame leg 46 in the leftward-rightward direction, the first frame leg 46 may be guided between the lower end of the vertical partition 9 and the first guide rail 51 without shaking.

In some implementations in which the corner of the lower end of the inner surface of the cabinet 10 is curved, it is difficult to install the second frame leg 47 at the curved portion. As a result, the second frame leg 47 and the inner surface 12 of the cabinet 10 may be excessively spaced apart from each other. For this reason, the third guide rail 53 is further disposed between the second guide rail 52 and the inner surface 12 of the cabinet 10 such that the third guide rail 53 is substantially spaced apart from the second guide rail 52 by a distance equivalent to the width of the second frame leg 47 in the leftward-rightward direction, whereby the second frame leg 47 is movable between the second guide rail 52 and the third guide rail 53.

The opposite side surfaces of the guide rails 51, 52, and 53 may contact the leg bodies 46*a*. Consequently, a lubricant may be applied to the contact surfaces, or additional bearing elements may be further provided.

FIG. 4 illustrates the front support rollers 67*a* and 67*b* located at the first drawer guides 31.

The withdrawal frame 40 may be provided with drawer guides 31, 32, and 33 for guiding the rollers 61, 62, 63, 72, and 73 of the drawers 21, 22, and 23 so as to be movable from the withdrawal frame 40 in the forward-rearward direction. The drawer guides 31, 32, and 33 may be fixed to the side parts 42 and 43 of the withdrawal frame 40. The drawers 21, 22, and 23 may be supported by the drawer guides 31, 32, and 33 disposed at the side parts 42 and 43 of the withdrawal frame 40 at heights corresponding to the drawers 21, 22, and 23.

A plurality of drawer guides 31, 32, and 33 may be provided at the respective side parts 42 and 43 so as to correspond to the drawers 21, 22, and 23 disposed in the storage compartment S. The first drawer 21, the second drawer 22, and the third drawer 23 are supported by the first drawer guide 31, the second drawer guide 32, and the third drawer guide 33, respectively. In some implementations, the first drawer 21 may be directly disposed on the base part 41, in which the first drawer guide 31 may be omitted.

At least one groove, into which the rollers 61, 62, 63, 72, and 73 of the drawers 21, 22, and 23 are inserted, may be formed in the drawer guides 31, 32, and 33 so as to extend in the forward-rearward direction. In some implementations in which the rear rollers 62 and 63 and the front rollers 72 and 73 are provided at sides of the drawers 22 and 23, the drawer guides 32 and 33 may include first support surfaces 321 for supporting and guiding the rear rollers 62 and 63 and second support surfaces 322 for supporting and guiding the front rollers 72 and 73 above the first support surfaces 321.

FIGS. 6 and 7 illustrate an example withdrawal frame 40, example side parts 42 and 43, and example rollers 67 and 68 for supporting the drawers 21, 22, and 23. The rollers 67 and 68 may include front support rollers 67 disposed at the front ends of the side parts 42 and 43 of the withdrawal frame 40 and rear support rollers 68 disposed at the rear ends of the side parts 42 and 43. The rear support rollers 68 may be located higher than the front support rollers 67.

The drawers 21, 22, and 23 may be provided at the sides thereof with first guide ribs 211, 221, and 231 extending in the forward-rearward direction and second guide ribs 222 and 232 disposed at the upper side of the first guide ribs 211, 221, and 231 and extending in the forward-rearward direction. The first guide ribs 211, 221, and 231 and the second guide ribs 222 and 232 may be supported by the front support rollers 67 and the rear support rollers 68.

In some implementations, the first guide ribs 211, 221, and 231 may be disposed at the lower side of the front rollers 72 and 73, and may extend from the rear to the front of the front rollers 72 and 73. The second guide ribs 222 and 232 may be formed at the rear of the front rollers 72 and 73.

FIG. 5 schematically illustrates the bottom of an example base part 41. FIG. 5(*a*) illustrates the state in which the door 3*d* is closed, FIG. 5(*b*) illustrates the state in which the door 3*d* is open from the state illustrated in FIG. 5(*a*) to a withdrawal start angle θe, FIG. 5(*c*) illustrates the state in which the door 3*d* is further open from the state illustrated in FIG. 5(*b*), FIG. 5(*d*) illustrates the state in which the door 3*d* is fully open, and FIG. 5(*e*) illustrates the state in which the door 3*d* is closed until the opening angle of the door reaches an insertion start angle θi.

As illustrated in FIG. 5, the withdrawal frame 40 may be connected to the door 3*d* via the link 70. One side of the link 70 may be rotatably connected to the door 3*d*, and the other side of the link 70 may be rotatably connected to a connection shaft 82 provided at the withdrawal frame 40. A rotary shaft 81 of the link 70 with respect to the door 3*d* is spaced apart from a rotary shaft C of the door 3*d* with respect to the cabinet 10 by a predetermined distance r. When the door 3*d* is opened and closed, therefore, the rotary shaft 81 of the link 70 moves along a circle having the rotary shaft C of the door 3*d* as the center and the distance r as the radius. As the position of the rotary shaft 81 of the link 70 on the circle is changed, the withdrawal frame 40, which is connected to the link 70, is moved.

In some implementations, the movement of the withdrawal frame 40 by the link 70 may not completely correspond to the opening and closing operation of the door 3*d*. That is, the withdrawal frame 40 remains stationary until the opening angle of the door 3*d* reaches to the withdrawal start angle θe after the door 3*d* starts to be opened from the closed state. When the opening angle of the door 3*d* exceeds the withdrawal start angle θe, the withdrawal frame 40 is moved forward by the link 70. On the other hand, the withdrawal frame 40 remains stationary until the opening angle of the door 3*d* reaches to the insertion start angle θi after the door 3*d* starts to be closed from the fully open state. When the door 3*d* is further closed (e.g. when the opening angle of the door 3*d* becomes smaller than the insertion start angle θi), the withdrawal frame 40 is moved rearward by the link 70. The insertion start angle θi may be smaller than the withdrawal start angle θe. In some implementations, the insertion start angle θi is about 60 degrees. In some implementations, the door 3*d* does not collide with the drawers 21, 22, and 23 or the withdrawal frame 40 in the state in which the door 3*d* is opened to the insertion start angle θi.

In order to move the withdrawal frame 40 as described above, the link 70 may be provided therein with a connection hole 71, which extends in the longitudinal direction of the link 70. The connection shaft 82 of the withdrawal frame 40 may be located in the connection hole 71. The connection shaft 82 may protrude from the bottom surface of the base part 41 so as to be inserted into the connection hole 71.

The connection hole 71 may extend so as to allow relative movement of the connection shaft 82 in the connection hole 71. That is, when the state shown in FIG. 5(*a*) is changed to the state illustrated in FIG. 5(*b*) as the door 3*d* is opened, the connection shaft 82 does not move, but the connection hole 71 moves. Consequently, the position of the connection shaft 82 relative to the connection hole 71 is changed. That is, in the section in which the opening angle of the door 3*d* reaches the withdrawal start angle θe from the closed state (e.g. the section in which the door is turned from the state illustrated in FIG. 5(*a*) to the state illustrated in FIG. 5(*b*)), the connection shaft 82 does not move, but the connection hole 71 moves. In other words, the connection shaft 82 moves relative to the connection hole 71.

When the door 3*d* is closed, the movement of the connection shaft 82 relative to the connection hole 71 may be performed until the door 3*d* is closed to the insertion start angle θi from the fully open state.

In the state in which the door 3*d* is closed (see FIG. 5(*a*)), the rear end of the connection hole 71 is spaced apart from the connection shaft 82. Consequently, the base part 41 does not move until the opening angle of the door 3*d* reaches the withdrawal start angle θe, whereby the rear end of the connection hole 71 comes into contact with the connection shaft 82. In the state in which the door 3*d* is closed, the distance between the connection shaft 82 and the rear end of the connection hole 71 may be set such that the withdrawal start angle θe does not exceed 90 degrees. In some implementations, the withdrawal start angle θe is about 70 to 80 degrees. However, the present disclosure is not limited thereto. In some implementations, the withdrawal frame 40 or the drawers 21, 22, and 23 must not collide with the door 3*d* when the withdrawal frame 40 is moved forward by the link 70 after the door 3*d* is opened to the withdrawal start angle θe. Consequently, the withdrawal start angle θe must be set in consideration of the rearward protruding lengths of the door storage units 8*a*, 8*b*, and 8*c*, and the link 70 must be designed accordingly.

In the state in which the door 3*d* is fully open (see FIG. 5(*d*)), the connection shaft 82 is spaced apart from the front end of the connection hole 71. When the door 3*d* starts to be closed from the fully open state and the opening angle of the door 3*d* reaches the insertion start angle θi, the front end of the connection hole 71 comes into contact with the connection shaft 82. The link pushes the withdrawal frame 40 rearward from this time until the door 3*d* is completely closed. That is, when the user closes the door 3*d*, the withdrawal frame 40 may be automatically returned to the original position thereof (e.g. the position of the withdrawal frame 40 in the state in which the door 3*d* is closed) by the link 70.

As illustrated in FIG. 5, P1 indicates the position of the connection shaft 82 in the state in which the door 3*d* is closed, P2 indicates the position of the connection shaft 82 in the state in which the door 3*d* is fully open, and d1 indicates the distance between P1 and P2, e.g. the distance that the base part 41 moves until the door 3*d* is fully opened from the closed state. The position of the connection shaft 82 is not changed until the door 3*d* is opened to the withdrawal start angle θe from the closed state (e.g. until the state illustrated in FIG. 5(*a*) is changed to the state illustrated in FIG. 5(*b*)). In addition, the position of the connection shaft 82 is not changed until the door 3*d* is closed to the insertion start angle θi from the fully open state (e.g. until the state illustrated in FIG. 5(*d*) is changed to the state shown in FIG. 5(*e*)).

When the user pulls the drawers 21, 22, and 23 as needed in the state in which the door 3*d* is open, the rollers 61, 62, 63, 72, and 73 of the drawers 21, 22, and 23 roll forward along the drawer guides 31, 32, and 33, whereby the drawers 21, 22, and 23 may be further withdrawn. In some implementations, even when the withdrawal frame 40 is fully withdrawn by the link 70, the front surfaces of the drawers 21, 22, and 23 do not pass beyond the front surface of the storage compartment S. Even in this case, when the user manually pulls the drawers 21, 22, and 23, the drawers 21, 22, and 23 may be withdrawn forward beyond the front surface of the storage compartment S.

As described above, the withdrawal frame starts to be withdrawn only when the door is turned to a predetermined angle or more, whereby it is possible to enable the door to be sufficiently opened before the withdrawal frame is withdrawn. Consequently, it is possible to prevent the collision between the withdrawal frame and the door. In some implementations in which the door storage unit is provided at the rear of the door as the capacity of the refrigerating compartment or the freezing compartment is greatly increased, it is possible to prevent the collision between the withdrawal frame and the door storage unit.

In addition, it is possible to withdraw the withdrawal frame using the link.

Furthermore, it is possible to adjust the time when the withdrawal frame is withdrawn or the distance that the withdrawal frame is withdrawn by appropriately designing the length and position of the connection hole formed in the link or the position of the connection hole provided in the withdrawal frame, whereby it is possible to apply the withdrawal frame to refrigerators having different standards.

What is claimed is:

1. A refrigerator comprising:

a cabinet that defines a storage compartment with an opening;

a door rotatably coupled to the cabinet and configured to open and close the opening;

a drawer located in the storage compartment and configured to store food;

a roller located at a side of the drawer;

a withdrawal frame that is located in the storage compartment, that is configured to support the drawer, and that is configured to move in a forward-rearward direction; and a link that is rotatably connected to the door at a side of the link and rotatably connected to a connection shaft at an other side of the link, that is configured to move the withdrawal frame forward based on the door being opened and to move the withdrawal frame rearward based on the door being closed, and that defines, along a longitudinal direction of the link, a connection hole that is configured to receive the connection shaft, the link being located at the withdrawal frame, wherein the withdrawal frame comprises:

a horizontal base part that includes the connection shaft;

a side part that extends upward from the horizontal base part; and a drawer guide that is located at the side part, that is configured to support the roller, and that is configured to guide the roller in the forward-rearward direction to enable the drawer to move in the forward-rearward direction relative to the withdrawal frame based on the withdrawal frame moving relative to the storage compartment.

2. The refrigerator according to claim 1, wherein the connection hole is configured to guide movement of the connection shaft in a direction that is perpendicular to a center axis of the connection shaft.

3. The refrigerator according to claim 2, wherein a rear end of the connection hole that is nearer to a rear of the refrigerator than a front end of the connection hole and that is spaced apart from the connection shaft based on the door being closed.

4. The refrigerator according to claim 3, wherein the rear end of the connection hole is configured to contact the connection shaft based on the door being opened to a predetermined withdrawal start angle defined with respect to a front surface of the refrigerator.

5. The refrigerator according to claim 4, wherein the predetermined withdrawal angle is less than or equal to 90 degrees.

6. The refrigerator according to claim 3, wherein the connection shaft is spaced apart from the front end of the connection hole based on the door being opened to a maximum withdrawal angle defined with respect to a front surface of the refrigerator.

7. The refrigerator according to claim 6, wherein the maximum withdrawal angle is greater than 90 degrees.

8. The refrigerator according to claim 1, wherein the withdrawal frame further comprises:

an additional side part that extends from the horizontal base part; and an additional drawer guide that is located at the additional side part and that faces the drawer guide.

9. The refrigerator according to claim 1, wherein the connection shaft protrudes downward from the horizontal base part.

10. The refrigerator according to claim 1, further comprising a pair of frame legs that protrude from a bottom surface of the horizontal base part and that are spaced apart from each other in a lateral direction of the storage compartment, each of the pair of frame legs comprising a plurality of rollers configured to move along a bottom of the storage compartment in the forward-rearward direction.

11. The refrigerator according to claim 10, further comprising a guide rail located at the bottom of the storage compartment and configured to guide movement of the pair of frame legs in the forward-rearward direction.

12. The refrigerator according to claim 11, further comprising:

a vertical partition that divides the interior of the storage compartment into a left part and a right part, wherein the vertical partition and the guide rail define a space that is configured to receive a first frame leg of the pair of frame legs.

13. The refrigerator according to claim 12, further comprising a pair of additional guide rails that define a space that is configured to receive a second frame leg of the pair of frame legs.

14. The refrigerator according to claim 1, further comprising:

additional drawers that located above or below the drawer, and additional drawer guides that are located at the withdrawal frame and that are configured to guide the additional drawers.

* * * * *